US006132889A

United States Patent [19]

Welty et al.

[11] Patent Number: 6,132,889

[45] **Date of Patent: *Oct. 17, 2000**

[54] COATED ARTICLE

[75] Inventors: Richard P. Welty, Boulder, Colo.; Patrick Jonte, Zionsville; Carl W. Trendelman, Carmel, both of Ind.

[73] Assignee: Vapor Technologies, Inc., Boulder, Colo.

[ * ] Notice: This patent is subject to a terminal disclaimer.

[21] Appl. No.: 09/365,149

[22] Filed: Jul. 30, 1999

[51] Int. Cl.[7] ..... B32B 15/04

[52] U.S. Cl. ..... 428/623; 428/627; 428/628; 428/632; 428/633; 428/660

[58] Field of Search ..... 428/621, 622, 428/623, 627, 632, 660, 635, 675, 680, 633, 629, 628

[56] References Cited

U.S. PATENT DOCUMENTS

| | | | |
|---|---|---|---|
| 4,904,542 | 2/1990 | Mroczkowski | 428/610 |
| 5,413,874 | 5/1995 | Moysan et al. | 428/627 |
| 5,478,659 | 12/1995 | Moysan et al. | 428/627 |
| 5,547,767 | 8/1996 | Paidassi et al. | 428/610 |
| 5,552,233 | 9/1996 | Moysan et al. | 428/627 |
| 5,626,972 | 5/1997 | Moysan et al. | 428/627 |
| 5,922,478 | 7/1999 | Welty et al. | 428/621 |
| 5,948,548 | 9/1999 | Welty et al. | 428/623 |
| 5,952,111 | 9/1999 | Sugg et al. | 428/623 |
| 5,989,730 | 11/1999 | Sugg et al. | 428/621 |

*Primary Examiner*—John J. Zimmerman
*Attorney, Agent, or Firm*—Myron B. Kapustij; Lloyd D. Doigan

[57] ABSTRACT

An article is coated with a multi-layer coating comprising a nickel layer, a refractory metal or refractory metal alloy layer, a refractory metal compound or refractory metal alloy compound layer, and a refractory metal oxide or refractory metal alloy oxide layer or a layer comprised of the reaction products of refractory metal or refractory metal alloy, oxygen and nitrogen. The coating is decorative and also provides abrasion protection, corrosion protection, and improved chemical resistance.

32 Claims, 1 Drawing Sheet

COATED ARTICLE

FIELD OF THE INVENTION

This invention relates to articles with a multi-layer decorative and protective coating thereon.

BACKGROUND OF THE INVENTION

It is currently the practice with various articles such as brass articles such as faucets, faucet escutcheons, door knobs, door handles, door escutcheons and the like to first buff and polish the surface of the article to a high gloss and to then apply a protective organic coating, such as one comprised of acrylics, urethanes, epoxies, and the like, onto this polished surface. This system has the drawback that the buffing and polishing operation, particularly if the article is of a complex shape, is labor intensive. Also, the known organic coatings are not always as durable as desired, and are susceptible to attack by chemicals such as bases and acids. It would, therefore, be quite advantageous if brass articles, or other articles such as plastic, ceramic, or metallic articles, could be provided with a coating which gave the article a decorative appearance, provided wear resistance and corrosion protection, and also provided improved chemical resistance such as acid resistance and base resistance. The present invention provides such a coating.

SUMMARY OF THE INVENTION

The present invention is directed to an article such as plastic, ceramic, or metallic article, particularly a metallic article, having a multi-layer coating deposited on at least a portion of its surface. More particularly, it is directed to an article or substrate, particularly a metallic article such as stainless steel, aluminum, brass or zinc, having deposited on its surface multiple superposed layers of certain specific materials. The coating is decorative and also provides corrosion resistance, wear resistance and improved resistance to chemicals such as acids and bases. In one embodiment the coating provides the appearance of highly polished brass, i.e. has a brass color tone. Thus, an article surface having the coating thereon simulates a highly polished brass surface.

The article first has deposited on its surface one or more plated layers. On top of the plated layers is then deposited, by vapor deposition, one or more vapor deposited layers. A first layer deposited directly on the surface of the substrate is comprised of nickel. The first layer may be monolithic or it may consist of two different nickel layers such as, for example, a semi-bright nickel layer deposited directly on the surface of the substrate and a bright nickel layer superimposed over the semi-bright nickel layer. Disposed over the nickel layer is a layer comprised of a non-precious refractory metal or metal alloy such as zirconium, titanium, hafnium, tantalum, or zirconium—titanium alloy, preferably zirconium, titanium, or zirconium—titanium alloy. Over the layer comprised of refractory metal or refractory metal alloy is a layer comprised of non-precious refractory metal compound or non-precious refractory metal alloy compound. Over the non-precious refractory metal compound or non-precious refractory metal alloy compound layer is a layer comprised of non-precious refractory metal oxide, non-precious refractory metal alloy oxide, or reaction products of non-precious refractory metal or metal alloy, oxygen and nitrogen.

The nickel layer is applied by plating such as electroplating or electroless plating. The non-precious refractory metal or non-precious refractory metal alloy layer, non-precious refractory metal compound or non-precious refractory metal alloy compound layer, and layer comprised of non-precious refractory metal oxide, non-precious refractory metal alloy oxide, or reaction products of non-precious refractory metal or non-precious refractory metal alloy, oxygen and nitrogen are applied by vapor deposition such as cathodic arc evaporation or sputtering.

DESCRIPTION OF THE PREFERRED EMBODIMENT

The article or substrate 12 can be comprised of any material such as plastic, ceramic, metal or metallic alloy. Preferably, it is a metal or metallic alloy such as copper, steel, brass, zinc, aluminum, nickel alloys, and the like. In preferred embodiments the substrate is brass or zinc.

Figure 1:
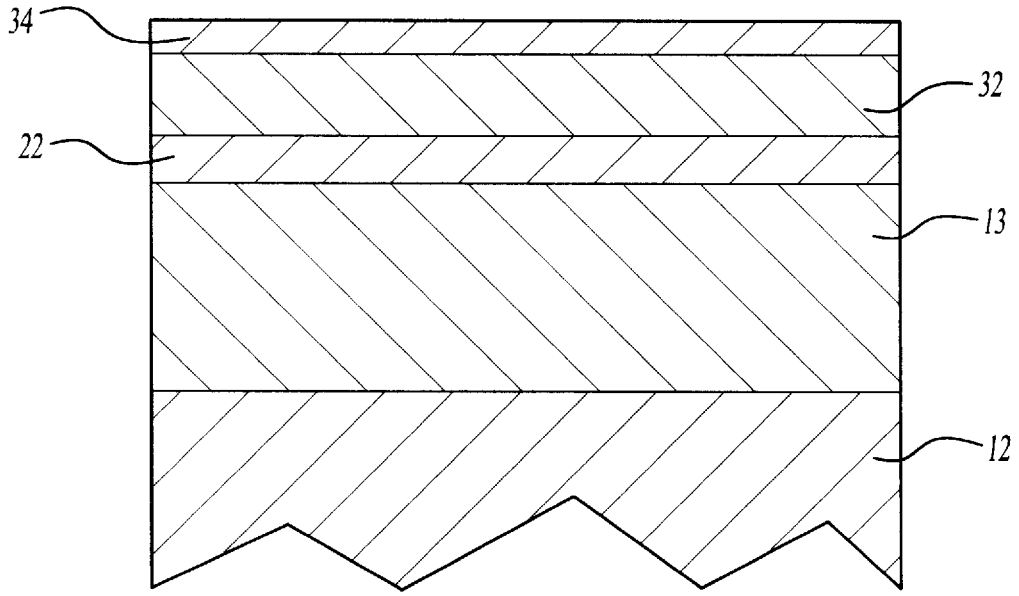
FIG. 1 is a cross-sectional view, not to scale, of a portion of the substrate having the multi-layer coating deposited by plating and vapor deposition on its surface.
Figure 2:
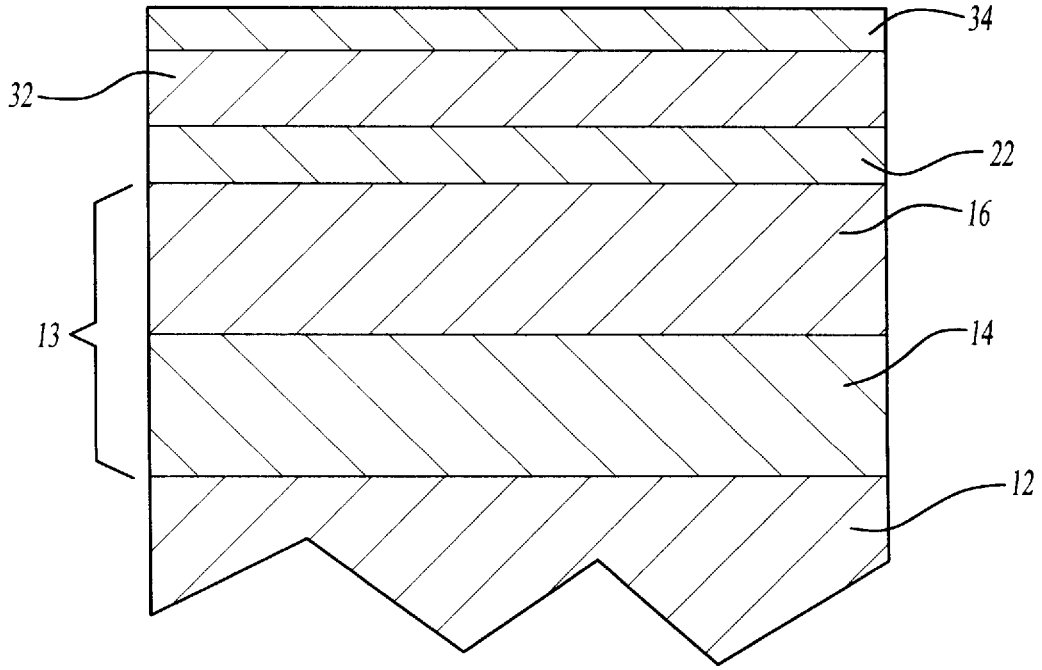
FIG. 2 is a view similar to FIG. 1 except that the nickel layer is comprised of a duplex nickel layer.

In the instant invention, as illustrated in FIGS. 1 and 2, a first layer or series of layers is applied onto the surface of the article by plating such as electroplating or electroless plating. A second series of layers is applied onto the surface of the plated layer or layers by vapor deposition such as physical vapor deposition or chemical vapor deposition. A nickel layer 13 may be deposited on the surface of the substrate 12 by conventional and well-known plating processes. These processes include electroplating processes using a conventional electroplating bath such as, for example, a Watts bath as the plating solution. Typically such baths contain nickel sulfate, nickel chloride, and boric acid dissolved in water. All chloride, sulfamate and fluoroborate plating solutions can also be used. These baths can optionally include a number of well known and conventionally used compounds such as leveling agents, brighteners, and the like. To produce specularly bright nickel layer at least one brightener from class I and at least one brightener from class II is added to the plating solution. Class I brighteners are organic compounds which contain sulfur. Class II brighteners are organic compounds which do not contain sulfur. Class II brighteners can also cause leveling and, when added to the plating bath without the sulfur-containing class I brighteners, result in semi-bright nickel deposits. These class I brighteners include alkyl naphthalene and benzene sulfonic acids, the benzene and naphthalene di- and trisulfonic acids, benzene and naphthalene sulfonamides, and sulfonamides such as saccharin, vinyl and allyl sulfonamides and sulfonic acids. The class II brighteners generally are unsaturated organic materials such as, for example, acetylenic or ethylenic alcohols, ethoxylated and propoxylated acetylenic alcohols, coumarins, and aldehydes. These Class I and Class II brighteners are well known to those skilled in the art and are readily commercially available. They are described, inter alia, in U.S. Pat. No. 4,421,611 incorporated herein by reference.

Electroless plating is conventional and well known and is described, inter alia, in U.S. Pat. Nos. 2,532,283; 2,532,284; 2,762,723; 5,494,710; 5,219,815; and in G. G. Gawrilon "Chemical (Electroless) Nickel Plating", Port Callis Press, 1979, all of which are incorporated herein by reference.

The nickel layer can be comprised of a monolithic layer such as semi-bright nickel or bright nickel, or it can be a duplex layer containing two different nickel layers, for example, a layer comprised of semi-bright nickel and a layer comprised of bright nickel. The thickness of the nickel layer is generally in the range of from about 100 millionths (0.000100) of an inch, preferably about 150 millionths (0.000150) of an inch to about 3,500 millionths (0.0035) of an inch.

As is well known in the art before the nickel layer is deposited on the substrate the substrate is subjected to acid activation by being placed in a conventional and well known acid bath.

In one embodiment as illustrated in FIG. 2, the nickel layer 13 is actually comprised of two different nickel layers 14 and 16. Layer 14 is comprised of semi-bright nickel while layer 16 is comprised of bright nickel. This duplex nickel deposit provides improved corrosion protection to the underlying substrate. The semi-bright, sulfur-free plate 14 is deposited by conventional plating processes, such as electroplating, directly on the surface of substrate 12. The substrate 12 containing the semi-bright nickel layer 14 is then placed in a bright nickel plating bath and the bright nickel layer 16 is deposited on the semi-bright nickel layer 14.

The thickness of the semi-bright nickel layer and the bright nickel layer is a thickness effective to provide improved corrosion protection. Generally, the thickness of the semi-bright nickel layer is at least about 50 millionths (0.00005) of an inch, preferably at least about 100 millionths (0.0001) of an inch, and more preferably at least about 150 millionths (0.00015) of an inch. The upper thickness limit is generally not critical and is governed by secondary considerations such as cost. Generally, however, a thickness of about 1,500 millionths (0.0015) of an inch, preferably about 1,000 millionths (0.001) of an inch, and more preferably about 750 millionths (0.00075) of an inch should not be exceeded. The bright nickel layer 16 generally has a thickness of at least about 50 millionths (0.00005) of an inch, preferably at least about 125 millionths (0.000125) of an inch, and more preferably at least about 250 millionths (0.00025) of an inch. The upper thickness range of the bright nickel layer is not critical and is generally controlled by considerations such as cost. Generally, however, a thickness of about 2,500 millionths (0.0025) of an inch, preferably about 2,000 millionths (0.002) of an inch, and more preferably about 1,500 millionths (0.0015) of an inch should not be exceeded. The bright nickel layer 16 also functions as a leveling layer which tends to cover or fill in imperfections in the substrate.

Disposed over the nickel layer 13 is a layer 22 comprised of a non-precious refractory metal or metal alloy such as hafnium, tantalum, zirconium, titanium or zirconium—titanium alloy, preferably zirconium, titanium or zirconium—titanium alloy, and more preferably zirconium or zirconium—titanium alloy.

Layer 22 is deposited on layer 13 by conventional and well known techniques including vapor deposition such as cathodic arc evaporation (CAE) or sputtering, and the like. Sputtering techniques and equipment are disclosed, inter alia, in J. Vossen and W. Kern "Thin Film Processes II", Academic Press, 1991; R. Boxman et al, "Handbook of Vacuum Arc Science and Technology", Noyes Pub., 1995; and U.S. Pat. Nos. 4,162,954, and 4,591,418, all of which are incorporated herein by reference.

Briefly, in the sputtering deposition process a refractory metal (such as titanium or zirconium) target, which is the cathode, and the substrate are placed in a vacuum chamber. The air in the chamber is evacuated to produce vacuum conditions in the chamber. An inert gas, such as Argon, is introduced into the chamber. The gas particles are ionized and are accelerated to the target to dislodge titanium or zirconium atoms. The dislodged target material is then typically deposited as a coating film on the substrate.

In cathodic arc evaporation, an electric arc of typically several hundred amperes is struck on the surface of a metal cathode such as zirconium or titanium. The arc vaporizes the cathode material, which then condenses on the substrates forming a coating.

Layer 22 has a thickness which is generally at least effective to function as a strike layer and improve the adhesion of the non-precious refractory metal compound layer 32 to the nickel layer 13. This thickness is generally at least about 0.25 millionths (0.00000025) of an inch, preferably at least about 0.5 millionths (0.0000005) of an inch, and more preferably at least about one millionth (0.000001) of an inch. The upper thickness range is not critical and is generally dependent upon secondary considerations such as cost. Generally, however, layer 22 should not be thicker than about 50 millionths (0.00005) of an inch, preferably about 15 millionths (0.000015) of an inch, and more preferably about 10 millionths (0.000010) of an inch.

In a preferred embodiment of the present invention layer 22 is comprised of titanium, zirconium or zirconium—titanium alloy, preferably zirconium or zirconium—titanium alloy, and is deposited by sputtering or cathodic arc evaporation.

Vapor deposited over layer 22 is a layer 32 comprised of a non-precious refractory metal compound or non-precious refractory metal alloy compound, preferably a nitride, carbide or carbonitride, and more preferably a nitride.

Layer 32 is comprised of a hafnium compound, a tantalum compound, a titanium compound, a zirconium—titanium alloy compound, or a zirconium compound, preferably a titanium compound, a zirconium—titanium alloy compound, or a zirconium compound, and more preferably a zirconium compound or a zirconium—titanium alloy compound. The titanium compound is selected from titanium nitride, titanium carbide, and titanium carbonitride, with titanium nitride being preferred. The zirconium compound is selected from zirconium nitride, zirconium carbonitride, and zirconium carbide, with zirconium nitride being preferred. The zirconium—titanium alloy compound is selected from zirconium—titanium alloy carbide, zirconium—titanium alloy nitride, and zirconium—titanium carbonitride, with zirconium—titanium alloy nitride being preferred.

Layer 32 provides wear and abrasion resistance and the desired color or appearance, such as for example, polished brass. Layer 32 is deposited on layer 22 by any of the well known and conventional vapor deposition techniques, for example physical vapor deposition techniques such as reactive sputtering and cathodic arc evaporation.

Reactive cathodic arc evaporation and reactive sputtering are generally similar to ordinary sputtering and cathodic arc evaporation except that a reactive gas is introduced into the chamber which reacts with the dislodged target material. Thus, in the case where zirconium nitride is the layer 32, the cathode is comprised of zirconium and nitrogen is the reactive gas introduced into the chamber. By controlling the amount of nitrogen available to react with the zirconium, the color of the zirconium nitride can be adjusted to be similar to that of brass of various hues.

Layer 32 has a thickness at least effective to provide wear and abrasion resistance and the desired color or appearance. Generally, this thickness is at least 0.1 millionths (0.0000001) of an inch, preferably at least 1 millionth (0.000001) of an inch, and more preferably at least 2 millionths (0.000002) of an inch. The upper thickness range is generally not critical and is dependent upon secondary considerations such as cost. Generally a thickness of about 30 millionths (0.00003) of an inch, preferably about 25 millionths (0.000025) of an inch, and more preferably about 20millionths (0.000020) of an inch should not be exceeded.

In one embodiment zirconium nitride is a preferred coating material as it most closely provides the appearance of polished brass.

In one embodiment of the invention a layer 34 comprised of the reaction products of a non-precious refractory metal or metal alloy, an oxygen containing gas such as oxygen, and nitrogen is deposited onto layer 32. The non-precious refractory metals that may be employed in the practice of this invention are those which are capable of forming both a metal oxide and a metal nitride under suitable conditions, for example, using a reactive gas comprised of oxygen and nitrogen. The metals may be, for example, tantalum, hafnium, zirconium, zirconium—titanium alloy, and titanium, preferably titanium, zirconium—titanium alloy and zirconium, and more preferably zirconium.

The reaction products of the metal or metal alloy, oxygen and nitrogen are generally comprised of the metal or metal alloy oxide and metal or metal alloy nitride. Thus, for example, the reaction products of zirconium, oxygen and nitrogen comprise zirconium oxide and zirconium nitride. These metal oxides and metal nitrides including zirconium oxide and zirconium nitride alloys and their preparation and deposition are conventional and well known, and are disclosed, inter alia, in U.S. Pat. No. 5,367,285, the disclosure of which is incorporated herein by reference.

The layer 34 can be deposited by well known and conventional vapor deposition techniques, including reactive sputtering and reactive cathodic arc evaporation.

In another embodiment instead of layer 34 being comprised of the reaction products of a refractory metal or refractory metal alloy, oxygen and nitrogen, it is comprised of non-precious refractory metal oxide or non-precious refractory metal alloy oxide. The refractory metal oxides and refractory metal alloy oxides of which layer 34 is comprised include, but are not limited to, hafnium oxide, tantalum oxide, zirconium oxide, titanium oxide, and zirconium—titanium alloy oxide, preferably titanium oxide, zirconium oxide, and zirconium—titanium alloy oxide, and more preferably zirconium oxide and zirconium—titanium alloy oxide. These oxides and their preparation are conventional and well known.

Layer 34 containing (i) the reaction products of non-precious refractory metal or non-precious refractory metal alloy, oxygen and nitrogen, or (ii) non-precious refractory metal oxide or non-precious refractory metal alloy oxide generally has a thickness at least effective to provide improved chemical resistance such as improved resistance to acids and bases. Generally this thickness is at least about five hundredths of a millionth (0.00000005) of an inch, preferably at least about one tenth of a millionth (0.0000001) of an inch, and more preferably at least about 0.15 of a millionth (0.00000015) of an inch. Generally, layer 34 should not be so thick as to cover or obscure the appearance of layer 32. Generally, layer 34 should not be thicker than about five millionths (0.000005) of an inch, preferably about two millionths (0.000002) of an inch, and more preferably about one millionth (0.000001) of an inch.

In order that the invention may be more readily understood the following example is provided. The example is illustrative and does not limit the invention thereto.

EXAMPLE 1

Brass faucets are placed in a conventional soak cleaner bath containing the standard and well known soaps, detergents, defloculants and the like which is maintained at a pH of 8.9–9.2 and a temperature of 180–200° F. for about 10 minutes. The brass faucets are then placed in a conventional ultrasonic alkaline cleaner bath. The ultrasonic cleaner bath has a pH of 8.9–9.2, is maintained at a temperature of about 160–180° F., and contains the conventional and well known soaps, detergents, defloculants and the like. After the ultrasonic cleaning the faucets are rinsed and placed in a conventional alkaline electro cleaner bath. The electro cleaner bath is maintained at a temperature of about 140–180° F., a pH of about 10.5–11.5, and contains standard and conventional detergents. The faucets are then rinsed twice and placed in a conventional acid activator bath. The acid activator bath has a pH of about 2.0–3.0, is at an ambient temperature, and contains a sodium fluoride based acid salt. The faucets are then rinsed twice and placed in a bright nickel plating bath for about 12 minutes. The bright nickel bath is generally a conventional bath which is maintained at a temperature of about 130–150° F., a pH of about 4.0, contains $NiSO_4$, $NiCl_2$, boric acid, and brighteners. A bright nickel layer of an average thickness of about 400 millionths (0.0004) of an inch is deposited on the faucet surface. The faucets are thoroughly rinsed in deionized water and then dried. The nickel plated faucets are placed in a cathodic arc evaporation plating vessel. The vessel is generally a cylindrical enclosure containing a vacuum chamber which is adapted to be evacuated by means of pumps. A source of argon gas is connected to the chamber by an adjustable valve for varying the rate of flow of argon into the chamber. In addition, a source of nitrogen gas is connected to the chamber by an adjustable valve for varying the rate of flow of nitrogen into the chamber.

A cylindrical cathode is mounted in the center of the chamber and connected to negative outputs of a variable D.C. power supply. The positive side of the power supply is connected to the chamber wall. The cathode material comprises zirconium.

The plated faucets are mounted on spindles, 16 of which are mounted on a ring around the outside of the cathode. The entire ring rotates around the cathode while each spindle also rotates around its own axis, resulting in a so-called planetary motion which provides uniform exposure to the cathode for the multiple faucets mounted around each spindle. The ring typically rotates at several rpm, while each spindle makes several revolutions per ring revolution. The spindles are electrically isolated from the chamber and provided with rotatable contacts so that a bias voltage may be applied to the substrates during coating.

The vacuum chamber is evacuated to a pressure of about $5\times10^{-3}$ millibar and heated to about 150° C.

The electroplated faucets are then subjected to a high-bias arc plasma cleaning in which a (negative) bias voltage of about 500 volts is applied to the electroplated faucets while an arc of approximately 500 amperes is struck and sustained on the cathode. The duration of the cleaning is approximately five minutes.

Argon gas is introduced at a rate sufficient to maintain a pressure of about $3\times10^{-2}$ millibars. A layer of zirconium having an average thickness of about 4 millionths (0.000004) of an inch is deposited on the chrome plated faucets during a three minute period. The cathodic arc deposition process comprises applying D.C. power to the cathode to achieve a current flow of about 500 amps, introducing argon gas into the vessel to maintain the pressure in the vessel at about $1\times10^{-2}$ millibar, and rotating the faucets in a planetary fashion described above.

After the zirconium layer is deposited a zirconium nitride layer is applied onto the zirconium layer. A flow of nitrogen is introduced into the vacuum chamber while the arc discharge continues at approximately 500 amperes. The nitrogen flow rate is at a flow rate sufficient to fully react the zirconium atoms arriving at the substrate to form zirconium nitride.

The nitrogen flow rate is left at its maximum value (sufficient to form fully reacted zirconium nitride) for a time of five to ten minutes to form the abrasion resistant and color layer. After this zirconium nitride layer is deposited, an additional flow of oxygen of approximately 0.1 standard liters per minute is introduced for a time of thirty seconds to one minute, while maintaining nitrogen and argon flow rates at their previous values. A thin layer of mixed reaction products is formed (zirconium oxide and zirconium nitride), with thickness approximately 0.2 to 0.5 millionths of an inch. The arc is extinguished at the end of this last deposition period, the vacuum chamber is vented and the coated substrates removed.

While certain embodiments of the invention have been described for purposes of illustration, it is to be understood that there may be various embodiments and modifications within the general scope of the invention.

What is claimed is:

1. An article having on at least a portion of its surface a coating comprising, in order:

at least one layer comprised of nickel;

layer comprised of zirconium, titanium, hafnium or zirconium—titanium alloy;

color layer comprised of zirconium compound, titanium compound, hafnium compound or zirconium—titanium alloy compound; and thin layer having a thickness at least effective to provide improved chemical resistance comprised of zirconium oxide, titanium oxide, hafnium oxide or zirconium—titanium alloy oxide.

2. The article of claim 1 wherein said compound is selected from the carbides, carbonitrides and nitrides.

3. The article of claim 1 wherein said layer comprised of zirconium, titanium, hafnium or zirconium—titanium alloy is comprised of zirconium or zirconium—titanium alloy.

4. The article of claim 3 wherein said layer comprised of zirconium compound, titanium compound, hafnium compound or zirconium—titanium alloy compound is comprised of zirconium compound or zirconium—titanium alloy compound.

5. The article of claim 4 wherein said layer comprised of zirconium compound or zirconium—titanium alloy compound is comprised of zirconium nitride or zirconium—titanium alloy nitride.

6. The article of claim 5 wherein said layer comprised of zirconium oxide, titanium oxide, hafnium oxide or zirconium—titanium alloy oxide is comprised of zirconium oxide or zirconium—titanium alloy oxide.

7. The article of claim 2 wherein said compound is a nitride.

8. The article of claim 6 wherein said at least one layer comprised of nickel is comprised of one layer comprised of nickel.

9. The article of claim 1 wherein said at least one layer comprised of nickel is comprised of one layer comprised of nickel.

10. The article of claim 6 wherein said at least one layer comprised of nickel is comprised of two different layers comprised of nickel.

11. The article of claim 10 wherein one of said layers comprised of nickel is comprised of semi-bright nickel.

12. The article of claim 11 wherein the second of said layers comprised of nickel is comprised of bright nickel.

13. The article of claim 1 wherein said at least one layer comprised of nickel is comprised of two different layers comprised of nickel.

14. The article of claim 13 wherein one of said layers comprised of nickel is comprised of semi-bright nickel.

15. The article of claim 14 wherein the second of said layers comprised of nickel is comprised of bright nickel.

16. An article having on at least a portion of its surface a coating comprising, in order:

at least one layer comprised of nickel;

layer comprised of zirconium, titanium, hafnium or zirconium—titanium alloy;

color layer comprised of zirconium compound, titanium compound, hafnium compound or zirconium—titanium alloy compound; and thin layer having a thickness at least effective to provide improved chemical resistance comprised of reaction products of (i) zirconium, titanium, hafnium or zirconium—titanium alloy, (ii) oxygen and (iii) nitrogen.

17. The article of claim 16 wherein said compound is selected from carbides, carbonitrides and nitrides.

18. The article of claim 16 wherein said layer comprised of zirconium, titanium, hafnium or zirconium—titanium alloy is comprised of zirconium or zirconium—titanium alloy.

19. The article of claim 18 wherein said layer comprised of zirconium compound, titanium compound, hafnium compound or zirconium—titanium alloy compound is comprised of zirconium compound or zirconium—titanium alloy compound.

20. The article of claim 19 wherein said layer comprised of the reaction products of (i) zirconium, titanium, hafnium or zirconium—titanium alloy, (ii) oxygen and (iii) nitrogen is comprised of reaction products of (i) zirconium or zirconium—titanium alloy, (ii) oxygen and (iii) nitrogen.

21. An article having on at least a portion of its surface a coating comprising, in order:

layer comprised of semi-bright nickel;

layer comprised of bright nickel;

layer comprised of zirconium, titanium, hafnium or zirconium—titanium alloy;

color layer comprised of zirconium compound, titanium compound, hafnium compound or zirconium—titanium alloy compound; and thin layer having a thickness at least effective to provide improved chemical resistance comprised of zirconium oxide, titanium oxide, hafnium oxide or zirconium—titanium alloy oxide.

22. The article of claim 21 wherein said compound is selected from the carbides, carbonitrides and nitrides.

23. The article of claim 22 wherein said compound is a nitride.

24. The article of claim 21 wherein said layer comprised of zirconium compound, titanium compound, hafnium compound or zirconium—titanium alloy compound is comprised of zirconium compound or zirconium—titanium alloy compound.

25. The article of claim 24 wherein said compound is a nitride.

26. The article of claim 25 wherein said layer comprised of zirconium oxide, titanium oxide, hafnium oxide or zirconium—titanium alloy oxide is comprised of zirconium oxide or zirconium—titanium alloy oxide.

27. An article having on at least a portion of its surface a coating comprising, in order:

layer comprised of semi-bright nickel;

layer comprised of bright nickel;

layer comprised of zirconium, titanium, hafnium or zirconium—titanium alloy;

color layer comprised of zirconium compound, titanium compound, hafnium compound or zirconium—titanium alloy compound; and thin layer having a thickness at least effective to provide improved chemical resistance comprised of reaction products of (i) zirconium, titanium, hafnium or zirconium—titanium alloy, (ii) oxygen and (iii) nitrogen.

28. The article of claim 27 wherein said compound is selected from carbides, carbonitrides and nitrides.

29. The article of claim 27 wherein said layer comprised of zirconium, titanium, hafnium or zirconium—titanium alloy is comprised of zirconium or zirconium—titanium alloy.

30. The article of claim 29 wherein said layer comprised of zirconium compound, titanium compound, hafnium compound or zirconium—titanium alloy compound is comprised of zirconium compound or zirconium—titanium alloy compound.

31. The article of claim 30 wherein said compound is a nitride.

32. The article of claim 30 wherein said layer comprised of the reaction products of (i) zirconium, titanium, hafnium or zirconium—titanium alloy, (ii) oxygen and (iii) nitrogen is comprised of the reaction products of (i) zirconium or zirconium—titanium alloy, (ii) oxygen and (iii) nitrogen.

* * * * *